US006973276B2

(12) United States Patent
Mizoguchi

(10) Patent No.: US 6,973,276 B2
(45) Date of Patent: Dec. 6, 2005

(54) IMAGE FORMING APPARATUS

(75) Inventor: Yoshihiro Mizoguchi, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 175 days.

(21) Appl. No.: 10/618,031

(22) Filed: Jul. 11, 2003

(65) Prior Publication Data

US 2004/0009004 A1 Jan. 15, 2004

(30) Foreign Application Priority Data

Jul. 12, 2002 (JP) ..... P. 2002-203813
Sep. 12, 2002 (JP) ..... P. 2002-266719
Jun. 25, 2003 (JP) ..... P. 2003-180835

(51) Int. Cl.[7] ..... G03G 15/00
(52) U.S. Cl. ..... 399/90
(58) Field of Search ..... 399/90, 88, 37, 399/25, 111

(56) References Cited

U.S. PATENT DOCUMENTS 5,339,133 A * 8/1994 Otomo et al. ..... 399/90
5,907,748 A * 5/1999 Kawana ..... 399/111
6,016,408 A * 1/2000 Hashimoto et al. ..... 399/90
6,285,847 B1 9/2001 Tanizaki et al. ..... 399/167
6,508,601 B1 * 1/2003 Lui et al. ..... 399/90
6,829,451 B2 * 12/2004 Ise ..... 399/90
2002/0085858 A1 7/2002 Yamaguchi et al. ..... 399/167

FOREIGN PATENT DOCUMENTS

JP 02-163761 6/1990
JP 09-160469 6/1997
JP 10-104912 4/1998
JP 2000-214654 8/2000
JP 2002-203812 7/2002

* cited by examiner

*Primary Examiner*—Christopher W. Fulton

(57) ABSTRACT

An image forming apparatus includes: image forming units provided detachably and each having a developing roller for supplying a toner to an electrostatic latent image formed on a charged photoconductor drum to form the electrostatic latent image into a visible image; an endless intermediate transfer belt which is provided in such a manner as to be capable of abutting against the photoconductor drum and is adapted to rotate in loop form by being supported in a tension-adjusted state by a plurality of rollers, and onto which a toner image developed on the photoconductor drum is transferred; and a high-voltage unit which is electrically and mechanically connected to the image forming units through terminals to supply predetermined electric power to the photoconductor drums, chargers, and the developing rollers of the image forming units. The image forming units are arranged to be moved in a width wise direction of the intermediate transfer belt so as to be connected to the high-voltage unit.

12 Claims, 14 Drawing Sheets

PRIOR ART FIG. 15
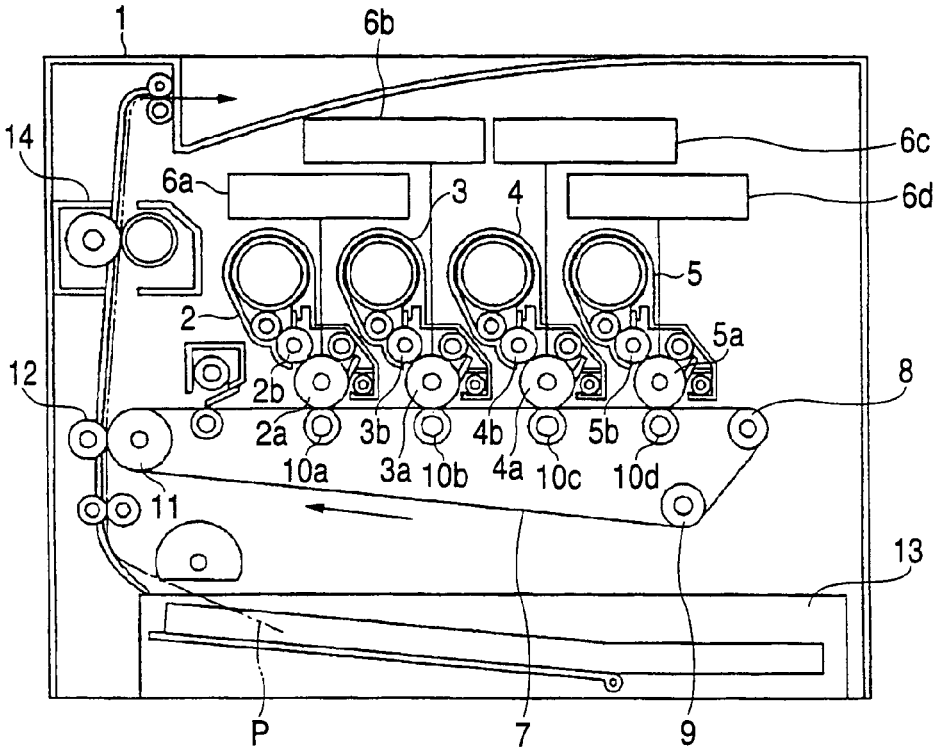
PRIOR ART FIG. 16
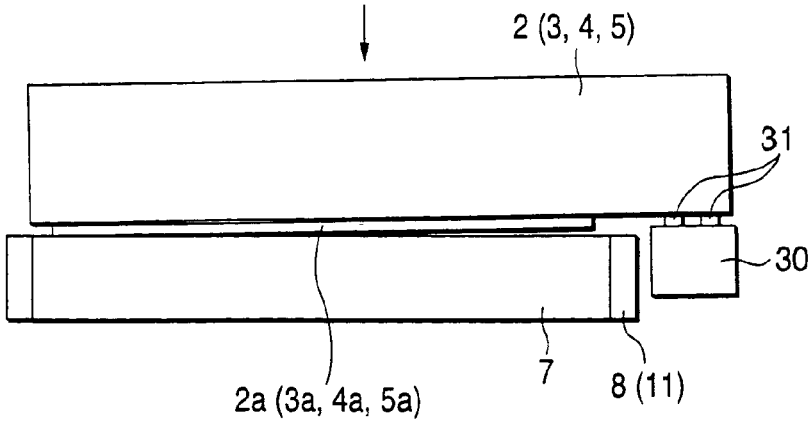

IMAGE FORMING APPARATUS

BACKGROUND OF THE INVENTION

The present invention relates to an image forming apparatus.

In an image forming apparatus adopting the electrophotographic process, it has conventionally been practiced to charge a photoconductor, i.e., an image carrier, with a charger, form a latent image by irradiating the charged photoconductor with light corresponding to image information, develop this latent image by a developing unit, and transfer the developed toner image onto a recording medium, so as to form an image.

On the other hand, in conjunction with a trend toward the coloring of images, a color image forming apparatus of a tandem type has also been proposed. This color image forming apparatus of this type has a plurality of image forming units which perform such image forming processes. Toner images of the respective colors of a cyan image, a magenta image, a yellow image and preferably a black image are formed on respective photoconductors. These toner images are subsequently transferred onto an endless intermediate transfer member in a superposed manner at transfer positions of the respective photoconductors, thereby forming a full-color image.

Such a color image forming apparatus of the tandem type is advantageous in high-speed operation since respective image forming sections are provided for the respective colors.

Hereafter, a description will be given of the conventional color image forming apparatus of the tandem type.

FIG. 15 is a schematic diagram illustrating the construction of the conventional color image forming apparatus. FIG. 16 is an explanatory diagram illustrating the positional relationship among image forming units, a high-voltage unit, and an intermediate transfer belt in a state in which the image forming units are installed in the color image forming apparatus shown in FIG. 15.

In FIG. 15, image forming units 2, 3, 4, and 5 for respectively forming toner images of the respective colors of yellow (Y), magenta (M), cyan (C), and black (K) are disposed in a main body 1 of the color image forming apparatus. Exposure units 6*a*, 6*b*, 6*c*, and 6*d* are provided in correspondence with the respective image forming units 2 to 5. The image forming units 2 to 5 are respectively provided with photoconductor drums (photoconductors) 2*a*, 3*a*, 4*a*, and 5*a* for forming electrostatic latent images on their peripheral surfaces by the irradiation of laser beams from the exposure units 6*a* to 6*d*, developing rollers (developing means) 2*b*, 3*b*, 4*b*, and 5*b* for forming the electrostatic latent images into visible images as toner images by causing toners supplied from toner tanks to adhere to the photoconductor drums 2*a* to 5*a*, and so on.

An endless intermediate transfer belt (intermediate transfer member) 7, onto which the respective toner images made visible on the photoconductor drums 2*a*, 3*a*, 4*a*, and 5*a* are transferred in a superposed manner to form a color toner image, is disposed on the lower side of the image forming units 2 to 5 so as to be capable of traveling in the direction of the arrow. A drive roller 8, a tension roller 9, four first transfer rollers 10*a*, 10*b*, 10*c*, and 10*d*, and a driven roller 11 are arranged in the loop of the intermediate transfer belt 7.

A paper feeding cassette 13, in which paper (recording medium) P is accommodated, is provided in a lower portion of the apparatus. The paper P is fed one sheet at a time from the paper feeding cassette 13 onto a paper transporting passage by a feed roller.

A second transfer roller 12 and a fixing unit 14 are arranged on the paper feeding passage. The second transfer roller 12 transfers the color image on the intermediate transfer belt 7 onto the paper P by coming into contact with an outer peripheral surface of the intermediate transfer belt 7 over a predetermined amount at the position of the driven roller 11. The fixing unit 14 allows the color image transferred onto the paper P to be fixed on the paper P.

In the image forming apparatus having such a construction, toner images of yellow, magenta, cyan, and black are caused to adhere to the surface of the intermediate transfer belt 7 by the photoconductor drums 2*a* to 5*a* of the image forming units 2 to 5, thereby forming a color image. Then, the color image based on these toners is transferred onto the paper P taken out from the paper feeding cassette 13 by a nipping force between the driven roller 11 and the second transfer roller 12. The paper P is subsequently supplied to the fixing unit 14 and is discharged after the toner image is fixed.

Such a color image forming apparatus is so structured that the image forming units 2 to 5 are installed or removed from above, i.e., from a direction perpendicular to the transfer surface of the intermediate transfer belt 7. In the state in which the image forming units 2 to 5 are installed, the image forming units 2 to 5 are electrically and mechanically connected via terminals 31 to a high-voltage unit 30 which is electric supply means for supplying predetermined electric power to the photoconductor drums 2*a* to 5*a* and the developing rollers 2*b* to 5*b* of the image forming units 2 to 5 and chargers for charging the photoconductor drums 2*a* to 5*a* to a predetermined potential (see FIG. 16).

A multiplicity of terminals for establishing electric contact with the photoconductor drums 2*a* to 5*a*, the developing rollers 2*b* to 5*b*, and the chargers are concentrated in the high-voltage unit 30. For this reason, in the above-described structure, the image forming units 2 to 5 are lifted by the high-voltage unit 30, as shown in FIG. 16. Therefore, it becomes difficult to make uniform the pressing balance of the photoconductor drums 2*a* to 5*a* with respect to the intermediate transfer belt 7.

As such, a portion where the pressing force is strong and a portion where it is weak or a noncontacting portion occur, i.e., one-sided contact occurs. Hence, a difference in density occurs in the developed toner image, so that it is impossible to obtain a high-quality printed image.

Further, in such a color image forming apparatus, a charger (charging means) 15 for charging the surface of each of the photoconductor drums 2*a* to 5*a* to a uniform potential by receiving electric supply from an electric supply means is provided for each of the photoconductor drums 2*a* to 5*a* by being supported by a conductive bearing 720, as shown in FIG. 18. This charger 15 is pressed against each of the photoconductor drums 2*a* to 5*a* by the resiliency of a coil spring 731 fitted between a leaf spring 730 and the bearing 720.

The leaf spring 730 is electrically connected to a main body-side conductive member 721 such as a coil spring for carrying electric power from the electric supply means. Accordingly, the electric power from the electric supply means is supplied from the main body-side conductive member 721 to the charger 15 through the leaf spring 730, the coil spring 731, and the bearing 720.

However, in the above-described construction, the number of component parts ranging from the electric supply means to the charger becomes numerous, resulting in higher cost.

In addition, since the main body-side conductive member merely abuts against the leaf spring, both members relatively move, so that the state of their mutual contact changes. In that event, noise can occur due to friction during movement, thereby rendering stable supply of electricity impossible.

SUMMARY OF THE INVENTION

Accordingly, an object of the invention is to provide an image forming apparatus which makes it possible to allow the photoconductor to be brought into pressure contact with the intermediate transfer member with a uniform pressing force.

Another object of the invention is to provide an image forming apparatus which, makes it possible to reduce the number of component parts ranging from the electric supply means to the charger and is capable of stably supplying electric power from the electric supply means to the charger.

To attain the above object, the image forming apparatus in accordance with the invention comprises: an image forming unit provided detachably and including a photoconductor provided rotatably, charging means for charging the photoconductor to a uniform potential, and developing means for supplying a toner to an electrostatic latent image formed on the charged photoconductor to form the electrostatic latent image into a visible image; an endless intermediate transfer member which is provided in such a manner as to be capable of abutting against the photoconductor and is adapted to rotate in loop form by being supported in a tension-adjusted state by a plurality of rollers, and onto which a toner image developed on the photoconductor is transferred; and electric supply means which is electrically and mechanically connected to the image forming unit through terminals to supply predetermined electric power to the photoconductor, the charging means, and the developing means of the image forming unit, wherein the image forming unit is arranged to be moved in a widthwise direction of the intermediate transfer member so as to be connected to the electric supply means.

Thus, the image forming unit is arranged to be moved in the widthwise direction of the intermediate transfer member so as to be connected to the electric supply means. Therefore, the installed image forming unit ceases to be lifted by the electric supply means, and the photoconductor can be brought into pressure contact with the intermediate transfer member with uniform pressing force.

Further, the image forming apparatus in accordance with the invention comprises: a photoconductor which is provided rotatably and on which an electrostatic latent image is formed into a visible image to form a toner image; charging means which is supported by an electrically conductive bearing and rotates accompanying the photoconductor, the charging means being adapted to charge a surface of the photoconductor to a uniform potential by receiving electric supply from electric supply means; and a coil spring which is bought into pressure contact with the bearing to press the charging means against the photoconductor through the bearing, the coil spring having a connecting end portion which is formed in such a manner as to extend in a rod shape and is electrically connected to a main body-side conductive member for carrying electric power from the electric supply means.

According to this arrangement, a feed line leading from the main body-side conductive member to the charging means is formed by only the coil spring and the bearing, so that it becomes possible to reduce the number of component parts.

In addition, in the above-described aspect of the invention, the image forming apparatus of the invention further comprises a connecting slot member which restricts the movement of the connecting end portion, and into which the main body-side conductive member is fitted with a distal end thereof abutting against the connecting end portion.

According to this arrangement, the distal end of the main body-side conductive member and the connecting slot member of the coil spring are fitted in the connecting slot member, and are thereby electrically connected to each other. Therefore, their respective free movement is restricted by the connecting slot member, and the state of their mutual contact is stabilized, making it possible to stably supply electric power from the electric supply means to the charger.

BRIEF DESCRIPTION OF DRAWINGS

FIG. 15 is a schematic diagram illustrating the construction of a conventional color image forming apparatus;

FIG. 16 is an explanatory diagram illustrating the positional relationship among the image forming units, the high-voltage unit, and the intermediate transfer belt in a state in which the image forming units are installed in the color image forming apparatus shown in FIG. 15;

DETAILED DESCRIPTION OF THE PREFERRED EMBODIMENTS

[First Embodiment]

Figure 1:
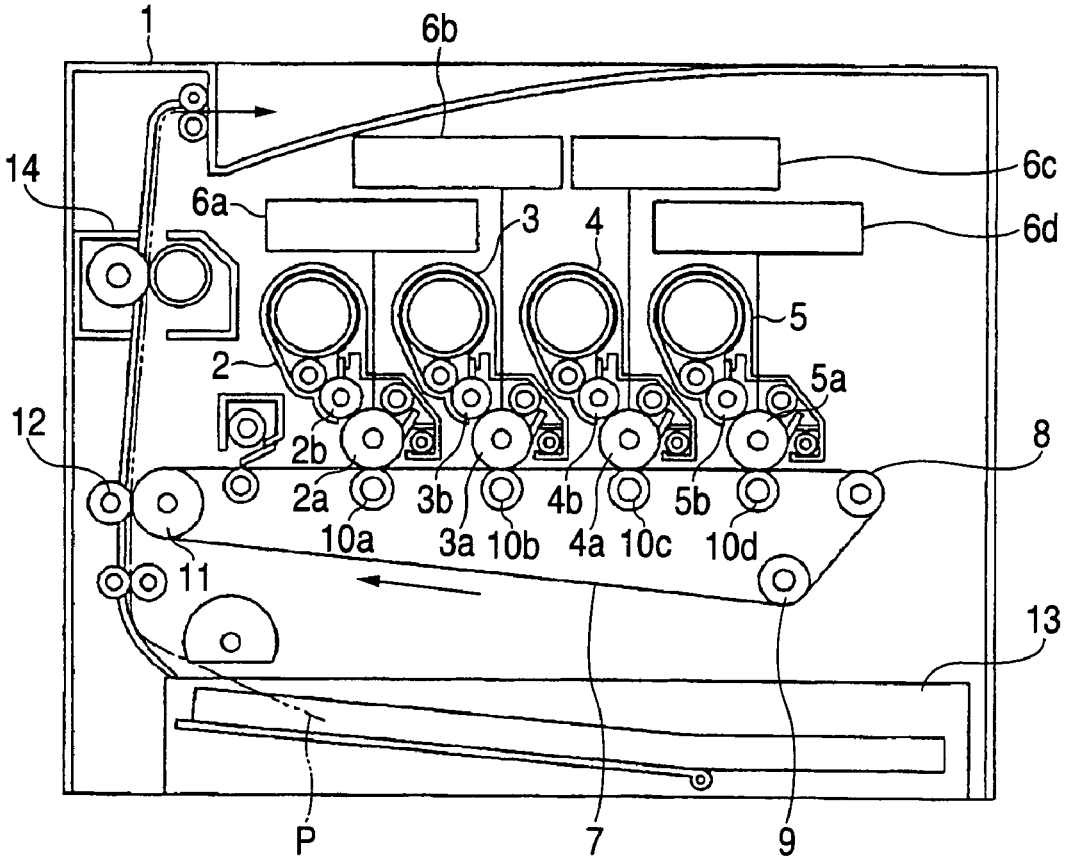
FIG. 1 is a schematic diagram illustrating the construction of a color image forming apparatus in accordance with an embodiment of the invention.

Referring now to FIGS. 1 to 4, a description will be given of an embodiment of the invention. It should be noted that in these drawings identical members will be denoted by the same reference numerals, and that a redundant description thereof will be omitted.

Figure 2:
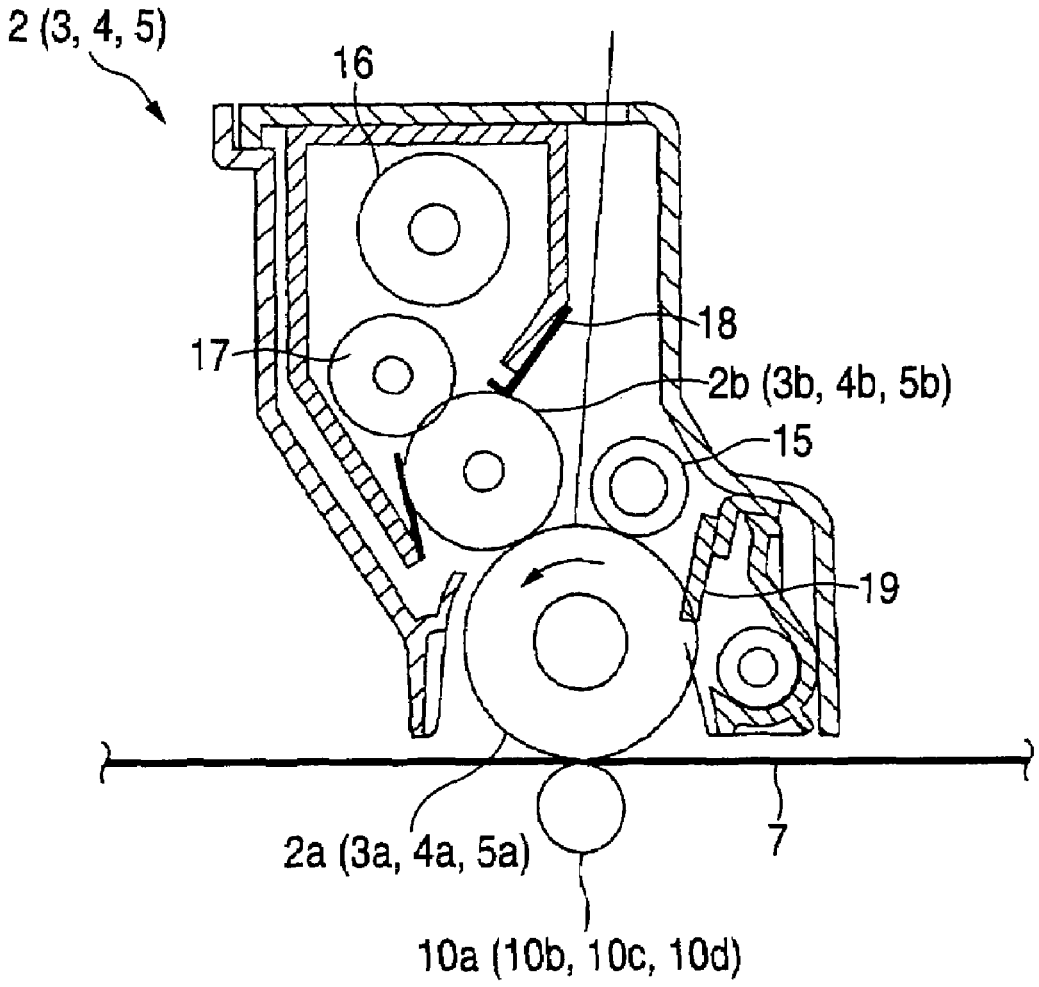
FIG. 2 is an explanatory diagram illustrating in detail image forming units in the color image forming apparatus shown in FIG. 1.
Figure 3:
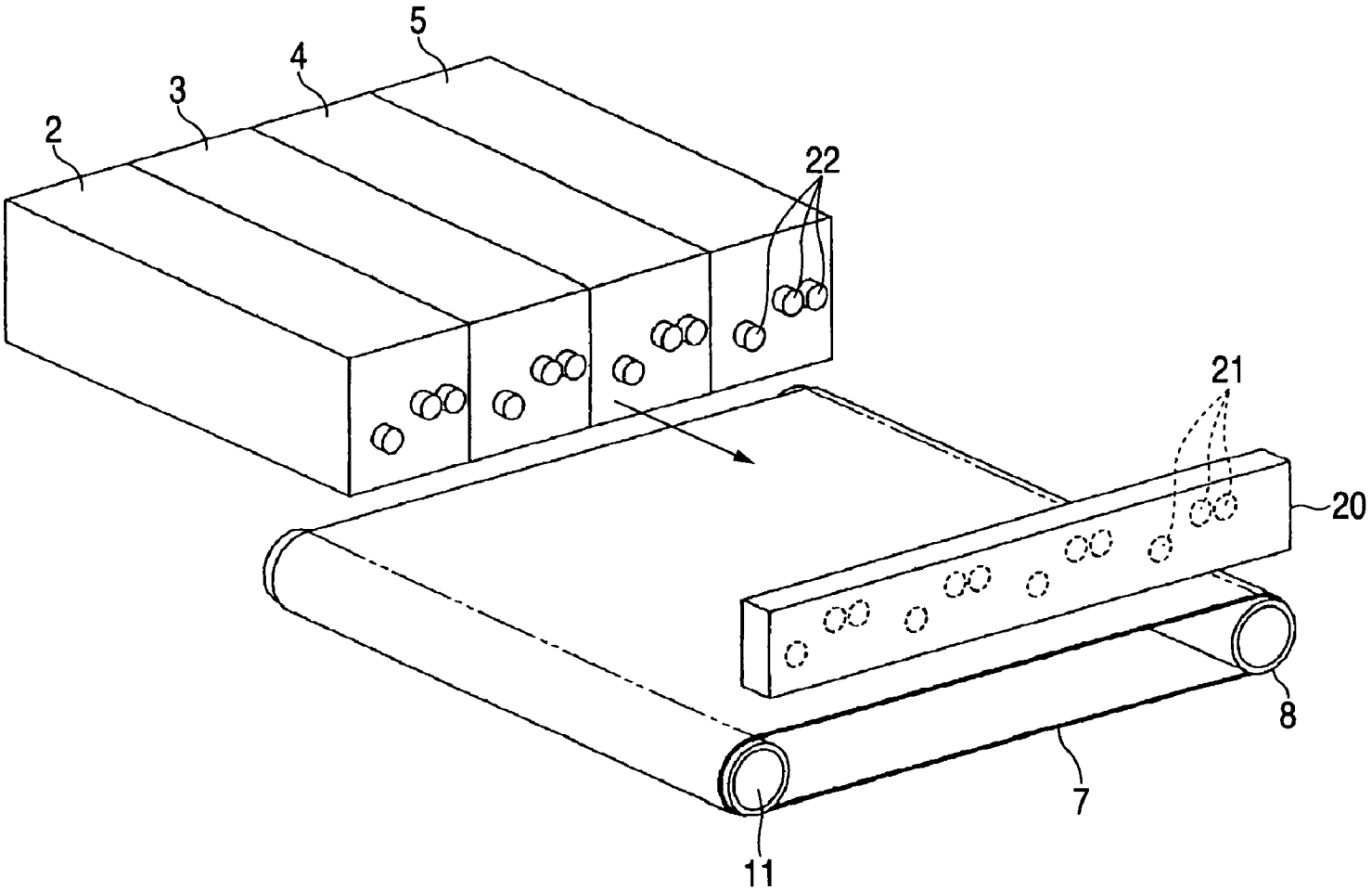
FIG. 3 is a perspective view illustrating in extracted form a high-voltage unit, an intermediate transfer belt, and the image forming units in the color image forming apparatus shown in FIG. 1.
Figure 4:
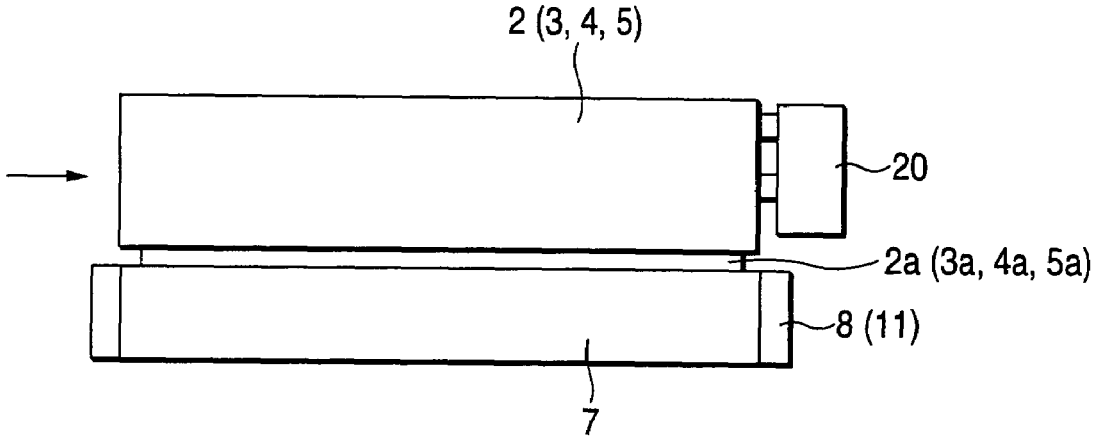
FIG. 4 is an explanatory diagram illustrating the positional relationship among the image forming units, the high-voltage unit, and the intermediate transfer belt in a state in which the image forming units are installed in the color image forming apparatus shown in FIG. 1.

FIG. 1 is a schematic diagram illustrating the construction of a color image forming apparatus in accordance with the embodiment of the invention. FIG. 2 is an explanatory diagram illustrating in detail image forming units in the color image forming apparatus shown in FIG. 1. FIG. 3 is a perspective view illustrating in extracted form a high-voltage unit, an intermediate transfer belt, and the image forming units in the color image forming apparatus shown in FIG. 1. FIG. 4 is an explanatory diagram illustrating the positional relationship among the image forming units, the high-voltage unit, and the intermediate transfer belt in a state in which the image forming units are installed in the color image forming apparatus shown in FIG. 1.

In FIG. 1, image forming units 2, 3, 4, and 5 for respectively forming toner images of the respective colors of yellow (Y), magenta (M), cyan (C), and black (K) are sequentially disposed detachably in a main body 1 of the color image forming apparatus. Exposure units 6*a*, 6*b*, 6*c*, and 6*d* are provided in correspondence with the respective image forming units 2 to 5.

As shown in detail in FIG. 2, the image forming units 2 to 5 are respectively comprised of photoconductor drums (photoconductors) 2*a*, 3*a*, 4*a*, and 5*a* serving as image carriers which are provided rotatably; chargers (charging means) 15 for charging these photoconductor drums 2*a* to 5*a* to a uniform potential; developing rollers (developing means) 2*b*, 3*b*, 4*b*, and 5*b* for forming electrostatic latent images into visible images as toner images by causing toners supplied from toner tanks to adhere to the photoconductor drums 2*a* to 5*a* on the peripheral surfaces of which electrostatic latent images have been formed by the irradiation of laser beams from the exposure units 6*a* to 6*d*; agitators 16 for agitating the toners in the toner tanks; supply rollers 17 for supplying the toners to the developing rollers 2*b* to 5*b*; doctor blades 18 for adjusting the thickness of the toners supplied to the developing rollers 2*b* to 5*b* to predetermined thickness and for charging the toners through friction; and cleaning blades 19 for removing the toners remaining on the photoconductor drums 2*a* to 5*a* after the image transfer onto an intermediate transfer belt 7. It should be noted that the photoconductor drums 2*a*, 3*a*, 4*a*, and 5*a* which rotate in the circumferential direction are arranged in a row such that their rotational axes become parallel to each other.

The endless intermediate transfer belt (intermediate transfer member) 7, onto which the respective toner images made visible on the photoconductor drums 2*a*, 3*a*, 4*a*, and 5*a* are transferred in a mutually superposed manner to form a color toner image, is disposed on the lower side of the arrayed image forming units 2 to 5 so as to be capable of traveling in the direction of the arrow. The following are arranged in the loop of the intermediate transfer belt 7: a drive roller 8 for causing this intermediate transfer belt 7 to travel; a tension roller 9 for imparting predetermined tension to the intermediate transfer belt 7; four first transfer rollers 10*a*, 10*b*, 10*c*, and 10*d* arranged in correspondence with the respective photoconductor drums 2*a* to 5*a* and adapted to cause the intermediate transfer belt 7 to come into pressure contact with the respective photoconductor drums 2*a* to 5*a* so as to transfer the respective color toner images on the photoconductor drums 2*a* to 5*a* onto the intermediate transfer belt 7; and a driven roller 11 which is rotated by the rotation of the intermediate transfer belt 7 by the drive roller 8. The intermediate transfer belt 7 is driven in loop form in the direction of the arrow by circuiting around these members.

During a printing period, the tension roller 9 imparts tension to the intermediate transfer belt 7 by moving to a lower right position in the drawing by being urged by a spring (not shown). During a nonprinting period, on the other hand, the imparting of the tension to the intermediate transfer belt 7 by the tension roller 9 is canceled so that winding kinks will not be produced in the intermediate transfer belt 7 as the intermediate transfer belt 7 is wound around the rollers at the same positions for a long time.

As shown in FIG. 3, a high-voltage unit (electric supply means) 20 is provided for supplying predetermined electric power to the photoconductor drums 2*a* to 5*a*, the chargers 15, and the developing rollers 2*b* to 5*b* of the image forming units 2 to 5. Terminals 21 corresponding to the photoconductor drums 2*a* to 5*a*, the chargers 15, and the developing rollers 2*b* to 5*b* are provided in the high-voltage unit 20. In a state in which the image forming units 2 to 5 are installed in the apparatus, these terminals 21 are fitted to terminals 22 provided on the image forming units 2 to 5, thereby allowing the high-voltage unit 20 and the image forming units 2 to 5 to be electrically and mechanically connected.

Here, as shown in the drawing, the image forming units 2 to 5 are so structured as to be moved in the widthwise direction of the intermediate transfer belt 7 so as to be connected to the high-voltage unit 20.

A paper feeding cassette 13, in which paper (recording medium) P is accommodated, is provided in a lower portion of the apparatus. The paper P is fed one sheet at a time from the paper feeding cassette 13 onto a paper transporting passage by a feed roller.

A second transfer roller 12 and a fixing unit 14 are arranged on the paper feeding passage. The second transfer roller 12 transfers the color image formed on the intermediate transfer belt 7 onto the paper P by coming into contact with an outer peripheral surface of the intermediate transfer belt 7 over a predetermined amount at the position of the driven roller 11. The fixing unit 14 allows the color image transferred onto the paper P to be fixed on the paper P by heat and pressure accompanying the nipping and rotation of the rollers.

In the image forming apparatus having such a construction, a latent image of a yellow color component of image information is first formed on the photoconductor drum 2*a* of the image forming unit 2. This latent image is formed into a visible image as a yellow toner image by the developing means 2*b* having a yellow toner, and is transferred onto the intermediate transfer belt 7 as a yellow toner image by the first transfer roller 10*a*.

In the meantime, while the yellow toner image is being transferred onto the intermediate transfer belt 7, a latent image of a magenta color component is formed in the image forming unit 3, and the magenta toner image based on the magenta toner is subsequently formed into a visible image by the developing means 3*b*. Then, the magenta toner image is transferred onto the intermediate transfer belt 7, for which the transfer of the yellow toner image has been completed by the previous image forming unit 2, by the first transfer roller 10*b* of the image forming unit 3 so as to be superposed on the yellow toner image.

Thereafter, image formation is effected with respect to the cyan toner image and the black toner image as well in a similar manner, and the superposition of the four-color toner images on the intermediate transfer belt 7 is completed.

The color image formed on the intermediate transfer belt 7 is collectively transferred onto the paper P fed from the paper feeding cassette 13 by the nipping force between the driven roller 11 and the second transfer roller 12. Then, the transferred toner image is heated and fixed on the paper P by the fixing unit 14, a full-color image is formed on this paper P, and the paper P is subsequently discharged.

In such a color image forming apparatus, as described before, the image forming units 2 to 5 are so structured as to be moved in the widthwise direction of the intermediate transfer belt 7 so as to be connected to the high-voltage unit 20 (FIG. 3).

Accordingly, in the state in which the image forming units 2 to 5 are installed in the main body of the apparatus, the image forming units 2 to 5 cease to be lifted by the high-voltage unit 20, as shown in FIG. 4, even if the terminals 22 of the image forming units 2 to 5 are fitted to the terminals 21 provided on the high-voltage unit 20. Consequently, since the photoconductor drums 2*a* to 5*a* are constantly brought into pressure contact with the intermediate transfer belt 7 with a uniform pressing force, it is possible to obtain a high-quality printed image which is free of a density difference caused by one-sided contact.

It should be noted that although a description has been given above by citing the example in which the invention is applied to the image forming apparatus for forming a color image, it is also possible to apply the invention to an image forming apparatus for forming a monochromatic image.

[Second Embodiment]

Referring next to FIGS. 5 to 14, a description will be given of a more detailed construction of the above-described first embodiment as a second embodiment of the invention. Those component parts that are substantially identical to those of the first embodiment will be denoted by the same reference numerals, and a redundant description thereof will be omitted.

Figure 5:
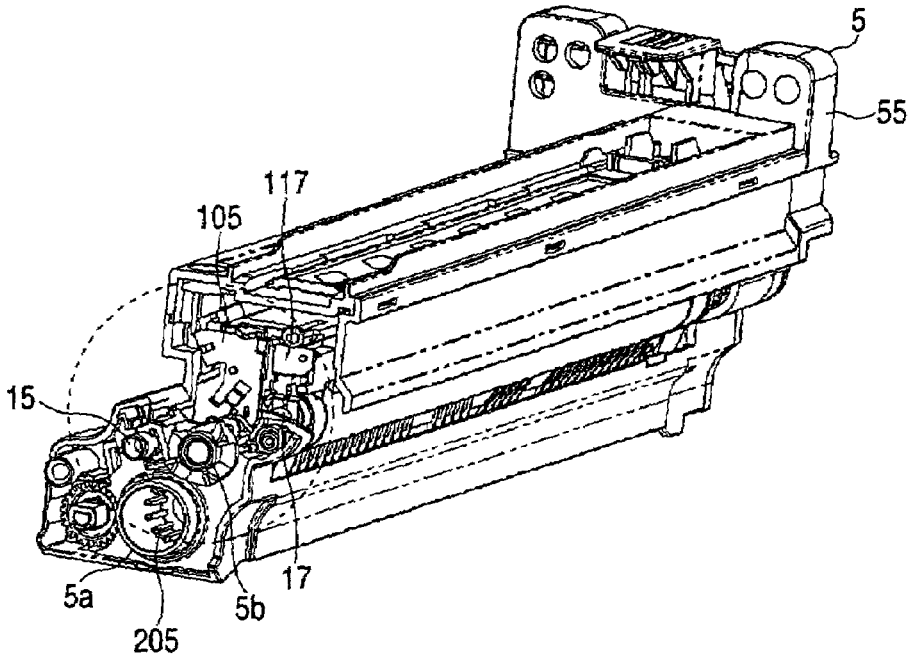
FIG. 5 is a perspective view illustrating a image forming unit in accordance with a second embodiment.
Figure 6:
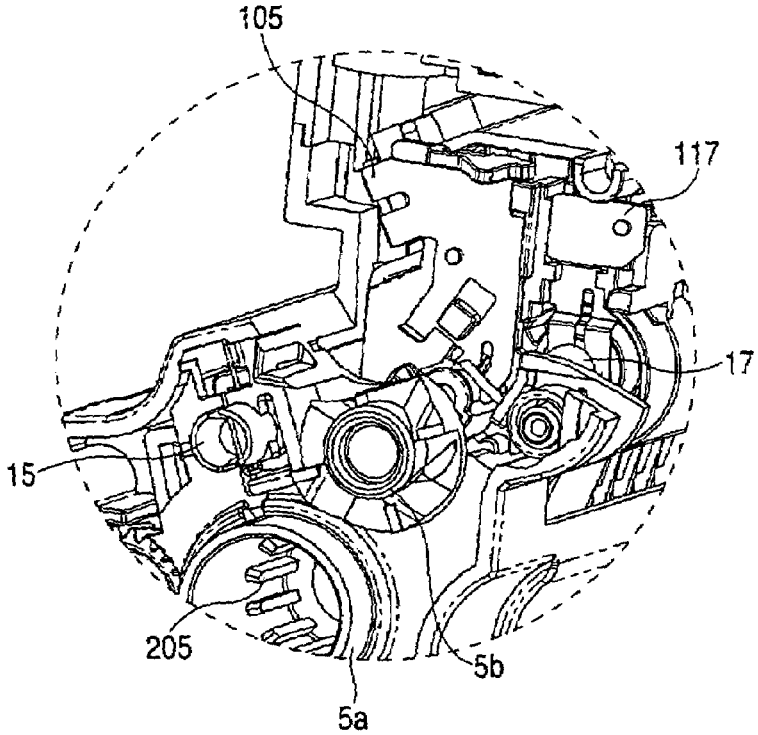
FIG. 6 is an enlarged view of parts in a broken-line circle shown in FIG. 5.

As shown in FIGS. 5 and 6, the photoconductor drum 5*a*, the developing roller 5*b*, the charging roller 15, the supply roller 17, a developing-roller biasing metal sheet 105, and a supply-roller biasing metal plate 117 are provided at an end portion of the image forming unit 5 for black on the side away from a grip portion 55. An end portion of the charging roller 15 is in electrical contact with the high-voltage unit 20, and corresponds to one of the terminals 22 in the above-described first embodiment. The developing-roller biasing metal sheet 105 is also in electrical contact with the high-voltage unit 20 and supplies electric power to the developing roller 5*b*. The supply-roller biasing metal plate 117 is also in electrical contact with the high-voltage unit 20 and supplies electric power to the supply roller 17. The developing-roller biasing metal sheet 105 and the supply-roller biasing metal plate 117 are formed of stainless steel (SUS 304), and correspond to portions of the terminals 22 in the above-described first embodiment.

Splines 205 are formed inside the photoconductor drum 5*a*, and as the splines 205 are engaged with a gear (not shown) provided on the main body 1 side of the color image forming apparatus, the driving force of the main body 1 side of the color image forming apparatus is transmitted to the photoconductor drum 5*a*. Here, one of the splines 205 is formed to be longer than the other splines 205. The arrangement provided is such that when the image forming unit 5 is slidingly installed into the main body 1 of the color image forming apparatus, engagement with the gear on the main body 1 side of the color image forming apparatus is facilitated. It should be noted that, as such a mechanical coupling, it is possible to use the one disclosed in US2002/0085858 A1 or the one disclosed in Japanese Patent Application No. 2002-203812.

The other image forming units 2, 3, and 4 also have similar constructions.

Figure 7:
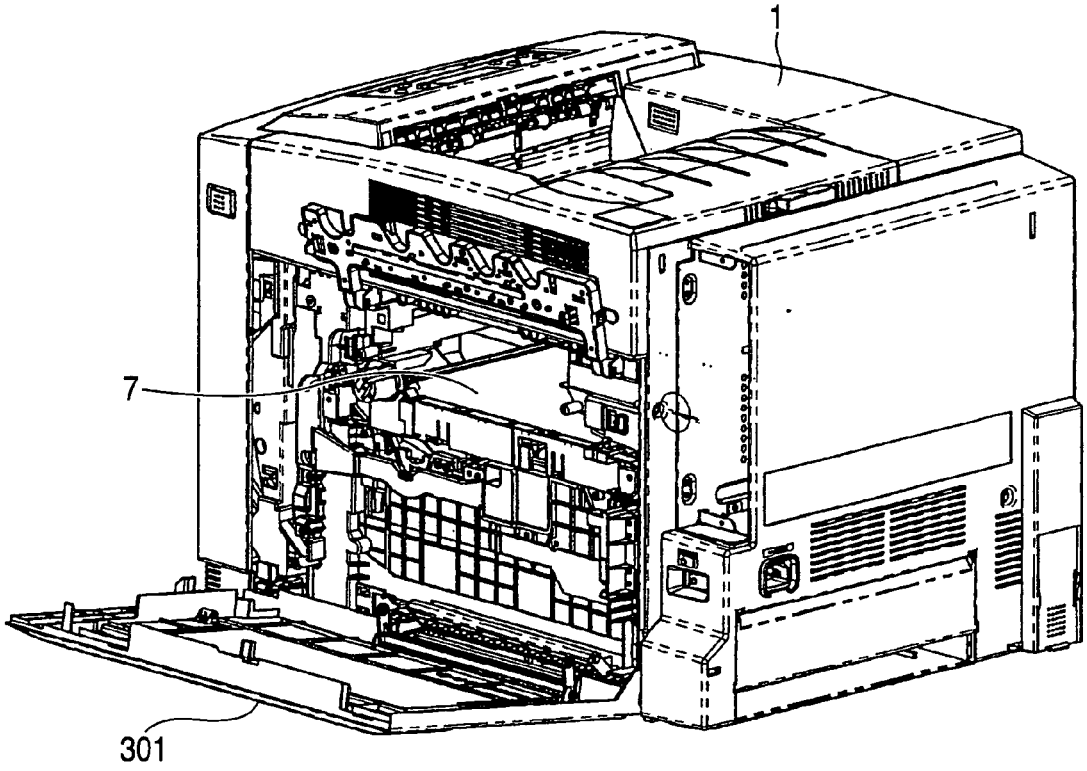
FIG. 7 is a perspective view illustrating a main body of the color image forming apparatus in accordance with a second embodiment of the invention.
Figure 8:
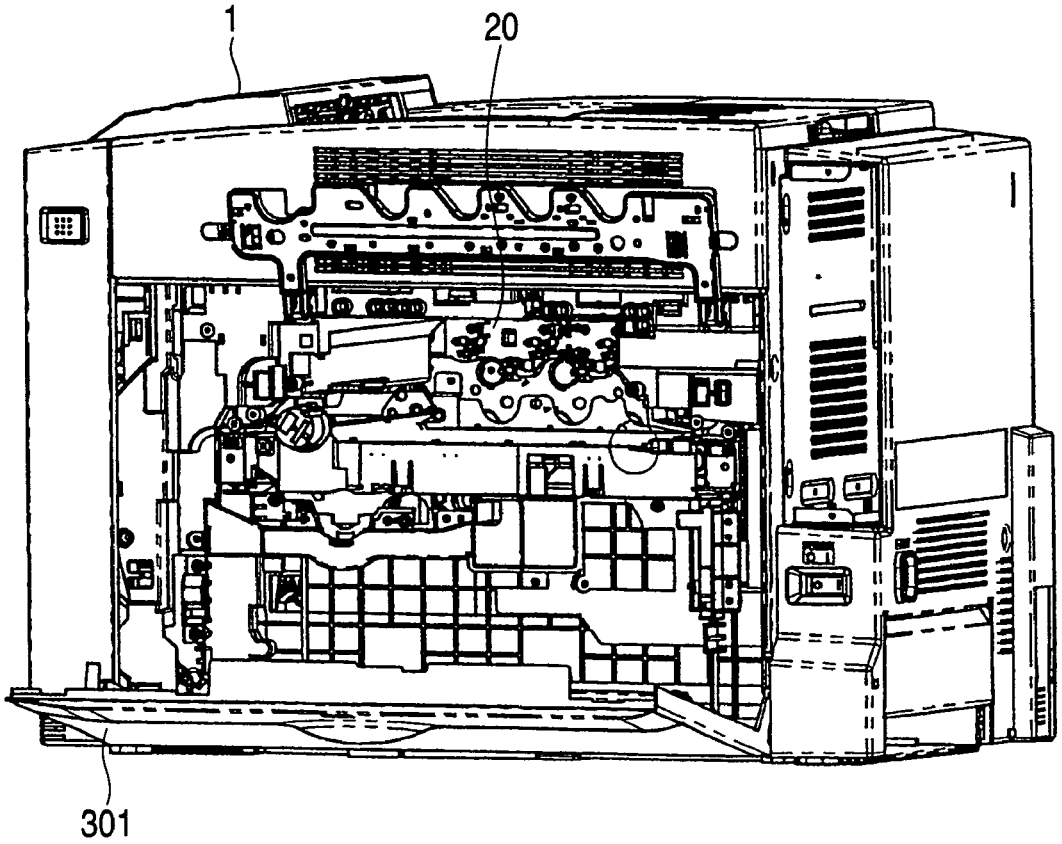
FIG. 8 is a front elevational view illustrating the main body of the color image forming apparatus in accordance with the second embodiment of the invention.

FIGS. 7 and 8 show a state prior to the installation of the image forming units 2, 3, 4, and 5 in the main body 1 of the color image forming apparatus, and this is a state in which a cover portion 301 is opened toward this side.

In FIG. 7, the image forming units 2, 3, 4, and 5 are inserted and installed through an opening where the cover portion 301 is open. At this time, each of the image forming units 2, 3, 4, and 5 is inserted in parallel to the intermediate transfer belt 7 starting with the end portion side where the developing-roller biasing metal sheet 105 and the supply-roller biasing metal plate 117 are provided, i.e., starting with the side away from the grip portion 55, so as to be installed in the main body 1 of the color image forming apparatus. Thus the developing-roller biasing metal sheet 105, the supply-roller biasing metal plate 117, and the like are brought into electric contact with the high-voltage unit 20 provided in the innermost recess of the main body 1 of the color image forming apparatus.

Figure 9:
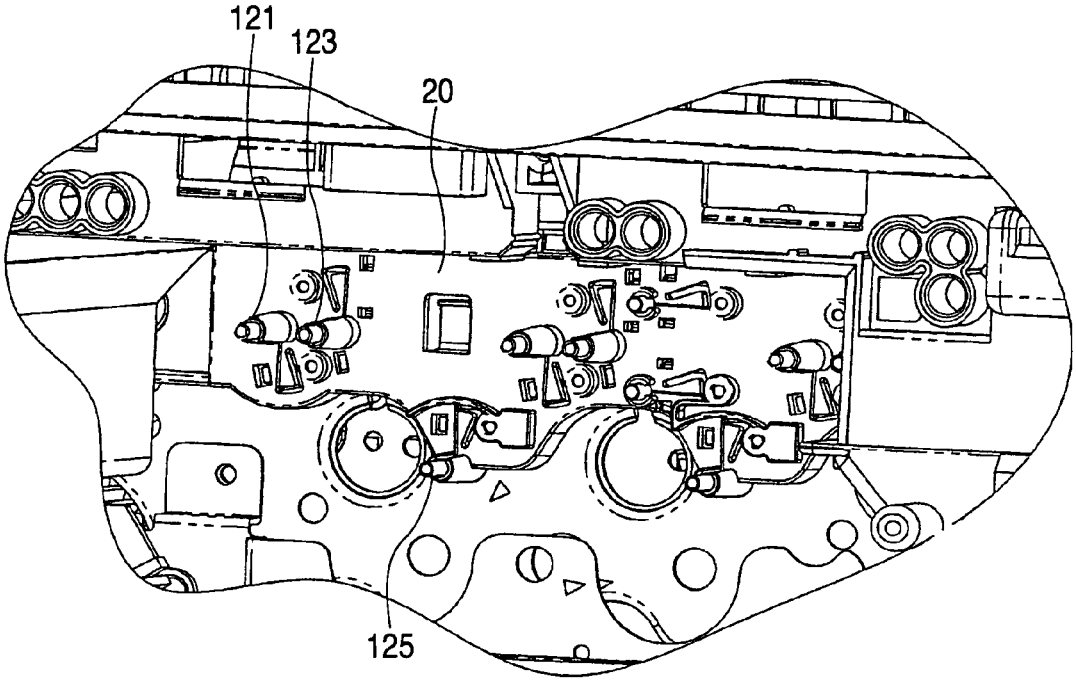
FIG. 9 is a fragmentary enlarged view illustrating a portion of the high-voltage unit in accordance with the second embodiment of the invention.
Figure 10:
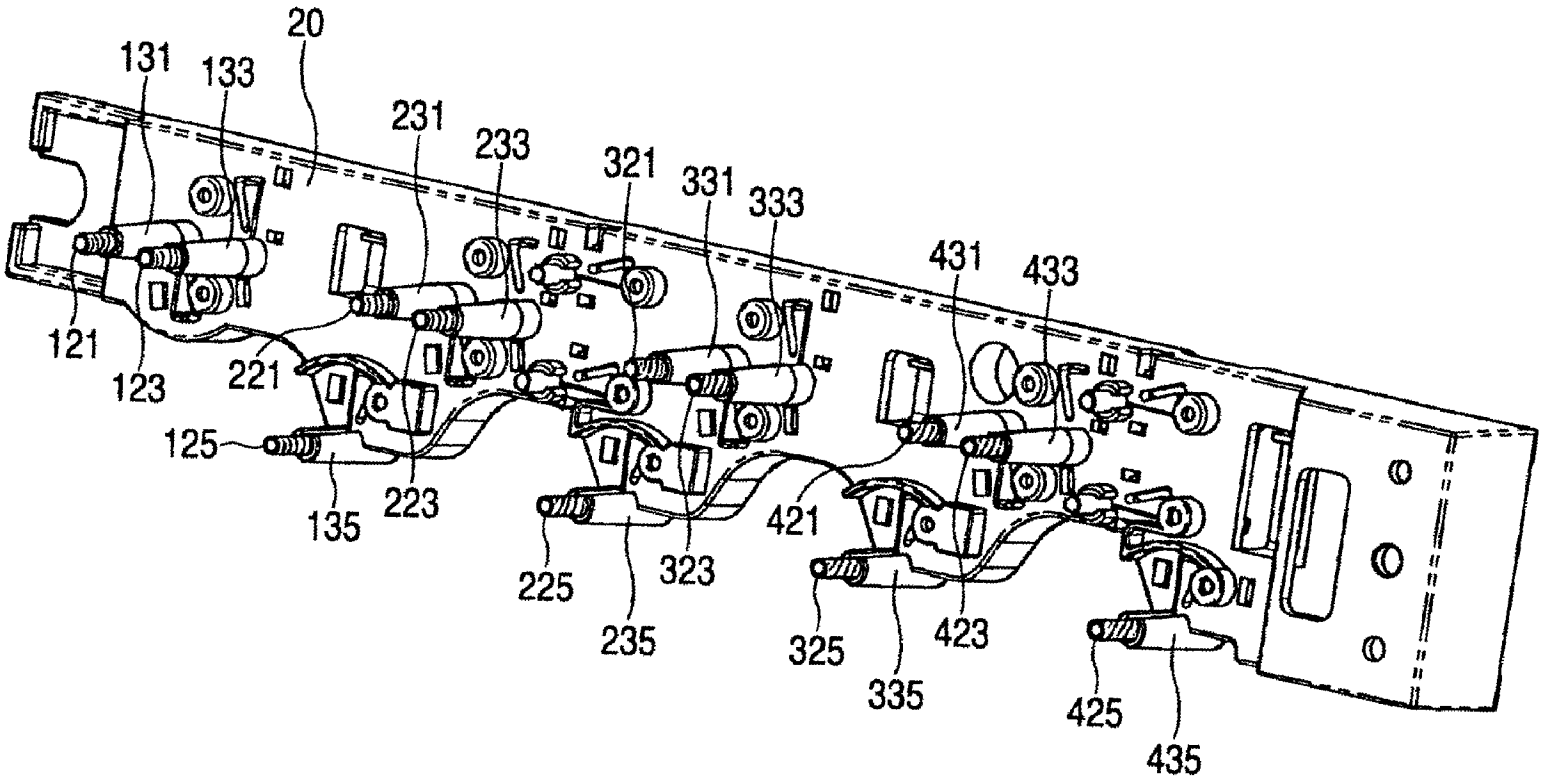
FIG. 10 is a perspective view illustrating the high-voltage unit in accordance with the second embodiment of the invention.
Figure 11:
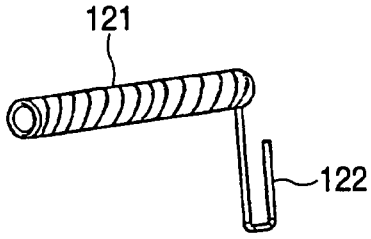
FIG. 11 is a perspective view illustrating a coil spring in accordance with the second embodiment of the invention.
Figure 12:
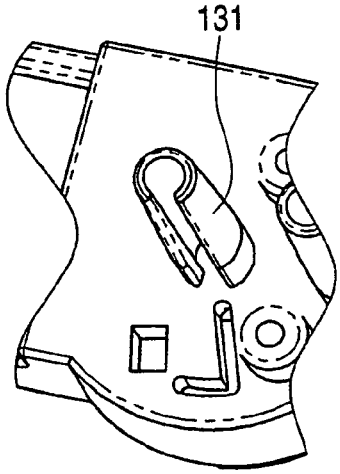
FIG. 12 is a perspective view illustrating a coil-spring supporting boss in accordance with the second embodiment of the invention.
Figure 13:
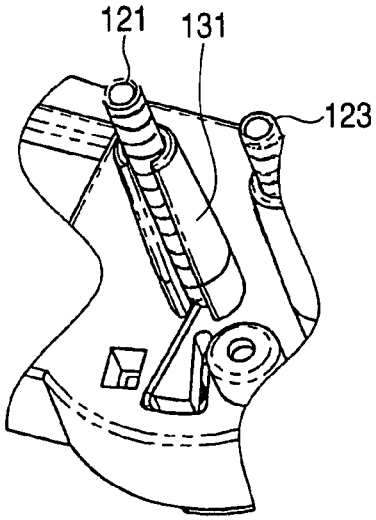
FIG. 13 is a perspective view illustrating a state in which the coil spring is assembled to the coil-spring supporting boss in accordance with the second embodiment of the invention.
Figure 14:
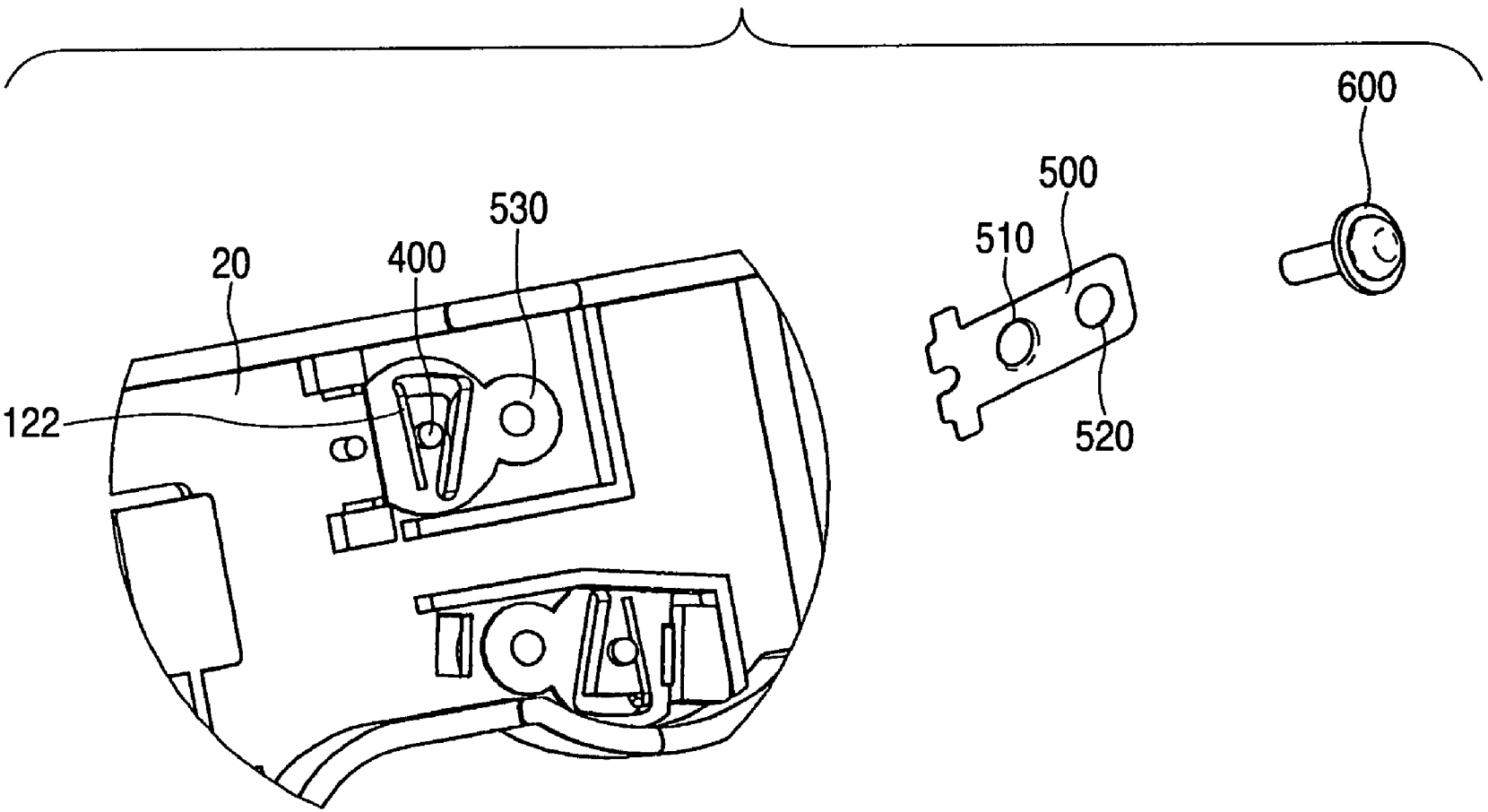
FIG. 14 is an exploded perspective view illustrating the rear surface of a portion of the high-voltage unit in accordance with the second embodiment of the invention.

FIG. 9 is a fragmentary enlarged view of the high-voltage unit 20, and FIG. 10 is a perspective view of the high-voltage unit 20. Hereafter, referring to FIGS. 9 to 14, a description will be given of the construction of the high-voltage unit 20 provided on the main body 1 side of the color image forming apparatus.

A coil spring 121 is brought into contact with the supply-roller biasing metal plate 117 to supply electric power to the supply roller 17 from a power source of the main body 1 of the color image forming apparatus 1. Similarly, a coil spring 123 is brought into contact with the developing-roller biasing metal sheet 105 to supply electric power to the developing roller 5*b*, and a coil spring 125 is inserted in a boss provided at an end portion of the charging roller 15 to supply electric power to the charging roller 15. The coil springs 121, 123, and 125 correspond to the terminals 21 of the first embodiment. By virtue of the above-described construction, in the state in which the image forming unit 5 is inserted in parallel to the intermediate transfer belt 7 and is installed in the main body 1 of the color image forming apparatus, electric power is supplied from the power source of the main body 1 of the color image forming apparatus to the image forming unit 5.

The coil spring 121 is formed of stainless steel (SUS 304), and a bent portion 122 for fixing is formed at one end thereof. The other coil springs 123 and 125 are also constructed in a similar manner.

Each of the coil springs 121, 123, and 125 is inserted in each of coil-spring supporting bosses 131, 133, and 135. In a state in which each of the coil springs 121, 123, and 125 is positioned after riding over a boss 400 on the rear side of the high-voltage unit, a shown in FIG. 14, each of the coil springs 121, 123, and 125 is fixed by a presser plate 500 and a screw 600. A hole 510 formed in the presser plate 500 is for positioning the boss 400 therein. A hole 520 formed in the presser plate 500 is for fixing the presser plate 500 to a fixing hole 530 in the high-voltage unit 20 by means of the screw 600.

In the above-described construction, a description has been given of only the portions corresponding to the image forming unit 5, the same applies to the other image forming units 2, 3, and 4 as well. Namely, coil springs 221, 223, and 225 supply electric power to the image forming unit 4, coil springs 321, 323, and 325 supply electric power to the image forming unit 3, and coil springs 421, 423, and 425 supply electric power to the image forming unit 2. The coil springs 221, 223, and 225, the coil springs 321, 323, and 325, and the coil springs 421, 423, and 425 respectively correspond to the coil springs 121, 123, and 125. Coil-spring supporting bosses 231, 233, and 235, coil-spring supporting bosses 331, 333, and 335, and coil-spring supporting bosses 431, 433, and 435 respectively correspond to the coil-spring supporting bosses 131, 133, and 135.

As described above, in accordance with the invention, the image forming unit is structured to be moved in the widthwise direction of the intermediate transfer member so as to be connected to the electric supply means. Therefore, effective advantages are obtained in that the installed image forming unit ceases to be lifted by the electric supply means, and that the photoconductor can be brought into pressure contact with the intermediate transfer member with a uniform pressing force.

[Third Embodiment]

Figure 17:
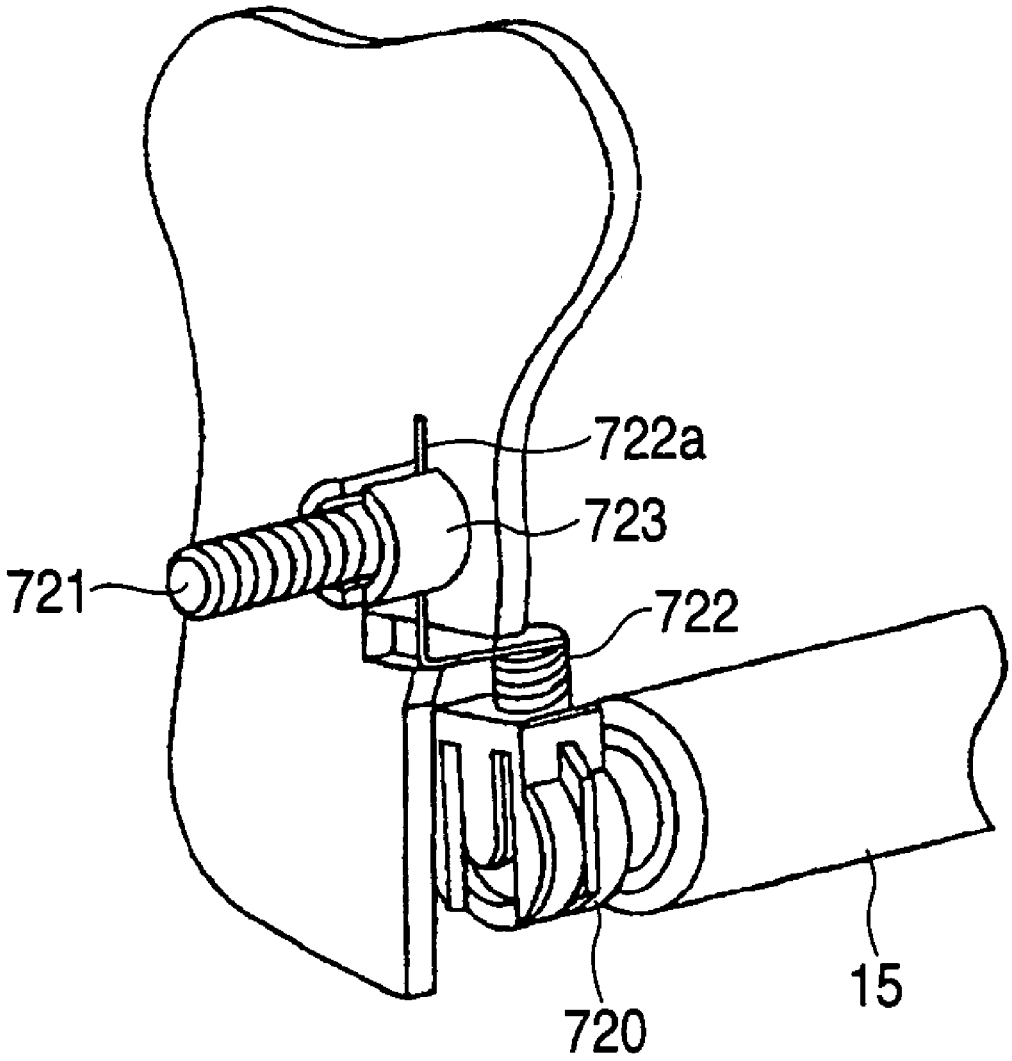
FIG. 17 is a perspective view illustrating a peripheral structure of the charging means provided in the color image forming apparatus.

FIG. 17 is a perspective view illustrating a peripheral structure of the charging means provided in the color image forming apparatus shown in FIG. 1.

Here, as shown in FIG. 17, the charger 15 is supported by a conductive bearing 720. A coil spring 722 is in pressure contact with the bearing 720, so that the charger 15 is pressed against each of the photoconductor drums 2*a* to 5*a* through the bearing 720 by the resiliency of the coil spring 722 acting on the bearing 720.

A connecting end portion 722*a* of the coil spring 722 is formed in such a manner as to extend like a rod formed substantially in an L-shape. A main body-side conductive member 721 for carrying electric power from an electric supply means (not shown) abuts against this connecting end portion 722*a* to electrically connect the two members.

As shown in the drawing, a distal end of the main body-side conductive member 721 is fitted in a connecting slot member 723 formed in the shape of a slotted tube. The distal end of the main body-side conductive member 721 is thus fitted in the connecting slot member 723, and the connecting end portion 722*a* of the coil spring 722 is also fitted therein. Thus, the movement of the connecting end portion 722*a* is restricted, and the distal end of the main body-side conductive member 721 abuts against the connecting end portion 722*a*.

Figure 18:
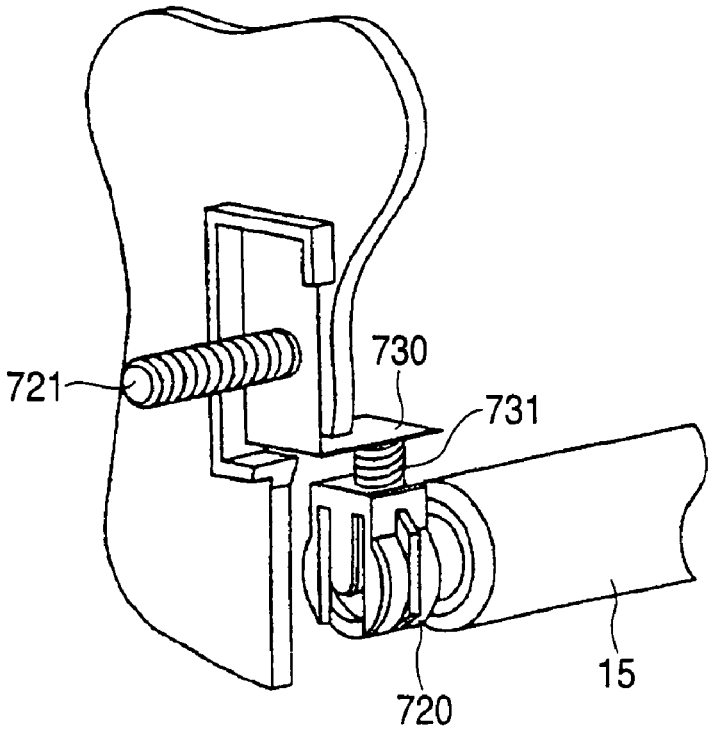
FIG. 18 PRIOR ART
FIG. 18 is a perspective view illustrating a peripheral structure of the charging means provided in the conventional color image forming apparatus.

In such a color image forming apparatus, as described above, the feed line leading from the main body-side conductive member 721 to the charger 15 is formed by only the coil spring 722 and the bearing 720. Therefore, the conventionally used leaf spring (see FIG. 18) becomes unnecessary, so that it becomes possible to reduce the number of component parts.

In addition, the distal end of the main body-side conductive member 721 and the connecting slot member 722*a* of the coil spring 722 are fitted in the connecting slot member 723, and are thereby electrically connected to each other. Therefore, their respective free movement is restricted by the connecting slot member 723, and the state of their mutual contact is stabilized. Thus, it becomes possible to stably supply electric power from the electric supply means to the charger 15.

It should be noted that although a description has been given above by citing the example in which the invention is applied to the image forming apparatus for forming a color image, it is also possible to apply the invention to an image forming apparatus for forming a monochromatic image.

As described above, in accordance with the invention, the feed line leading from the main body-side conductive member to the charging means is formed by only the coil spring and the bearing. Hence, an advantage is obtained in that it becomes possible to reduce the number of component parts.

In addition, in accordance with the invention, the distal end of the main body-side conductive member and the connecting slot member of the coil spring are fitted in the connecting slot member, and are thereby electrically connected to each other. Hence, their respective free movement is restricted by the connecting slot member, and the state of their mutual contact is stabilized. Therefore, an advantage is obtained in that it becomes possible to stably supply electric power from the electric supply means to the charger.

What is claimed is:

1. An image forming apparatus comprising:

an image forming unit provided detachably and including a photoconductor provided rotatably, charger for charging the photoconductor to a uniform potential, and a developing roller for supplying a toner to an electrostatic latent image formed on the charged photoconductor to form the electrostatic latent image into a visible image;

an endless intermediate transfer member which is provided in such a manner as to be capable of abutting against the photoconductor and is adapted to rotate in loop form by being supported in a tension-adjusted state by a plurality of rollers, and onto which a toner image is developed on the photoconductor is transferred; and an electric supply unit which is electrically and mechanically connected to the image forming unit through terminals to supply predetermined electric power to the photoconductor, the charger, and the developing roller of the image forming unit, wherein the image forming unit is moved in a widthwise direction of the intermediate transfer member so as to be connected to the electric supply unit.

2. An image forming apparatus comprising:

an image forming unit installed in a main body of the image forming apparatus and including a photoconductor drum, a charging roller for charging the photoconductor drum, and a developing roller for forming an electrostatic latent image formed on the photoconductor drum into a visible image by a toner;

a power supply unit provided in the main body of the image forming apparatus to supply electric power to the image forming unit; and a transfer belt which is provided in the main body of the image forming apparatus and onto which the toner image developed on the photoconductor drum is transferred, wherein a direction in which the image forming unit is installed in the image forming apparatus is a direction parallel to a portion of a surface of the transfer belt, and electrical contact between the power supply unit and the image forming unit is effected in the installing direction at an end portion in the installing direction of the image forming unit.

3. The image forming apparatus according to claim 2, wherein the photoconductor drum and the main body of the image forming apparatus are mechanically connected at the end portion in the installing direction of the image forming unit, and a driving force of the photoconductor drum is supplied from the main body of the image forming apparatus through the mechanical connection.

4. The image forming apparatus according to claim 3, wherein a direction of the electrical connection is parallel to the installing direction and a direction of the mechanical connection.

5. The image forming apparatus according to claim 2, wherein a plurality of image forming units are provided as the image forming unit in parallel to the portion of the surface of the transfer belt.

6. An image forming apparatus comprising:

an image forming unit installed in a main body of the image forming apparatus and including a photoconductor drum, a charging roller for charging the photoconductor drum, and a developing roller for forming an electrostatic latent image formed on the photoconductor drum into a visible image by a toner; and a power supply unit provided in the main body of the image forming apparatus to supply electric power to the image forming unit, wherein the photoconductor drum, the charging roller, and the developing roller are provided in parallel to a longitudinal direction of the image forming unit, the image forming unit has a longitudinally connecting terminal for mechanically connecting the power supply unit and the image forming unit in the longitudinal direction at an end portion in the longitudinal direction of the image forming unit, and the supply of the electric power from the power supply unit to the image forming unit is effected through the longitudinally connecting terminal.

7. The image forming apparatus according to claim 6, wherein the photoconductor drum and the main body of the image forming apparatus are mechanically connected at the end portion of the image forming unit, and a driving force of the photoconductor drum is supplied from the main body of the image forming apparatus through the mechanical connection.

8. The image forming apparatus according to claim 7, wherein a direction of connection between the power supply unit and the image forming unit by the longitudinally connecting terminal is parallel to the longitudinal direction and a direction of the mechanical connection between the photoconductor drum and the main body of the image forming apparatus.

9. The image forming apparatus according to claim 6, wherein a plurality of image forming units are provided as the image forming unit in parallel to the longitudinal direction.

10. The image forming apparatus according to claim 6, wherein the main body of the image forming apparatus has a transfer belt onto which the toner image developed on the photoconductor drum is transferred, and when the image forming unit is installed in the main body of the image forming apparatus, the photoconductor drum is pressed to the transfer belt at contact surfaces thereof with uniform pressure.

11. An image forming apparatus comprising:

a photoconductor which is provided rotatably and on which an electrostatic latent image is formed into a visible image to form a toner image;

charging means which is supported by an electrically conductive bearing and rotates accompanying the photoconductor, the charging means being adapted to charge a surface of the photoconductor to a uniform potential by receiving electric supply from electric supply means; and a coil spring which is bought into pressure contact with the bearing to press the charging means against the photoconductor through the bearing, the coil spring having a connecting end portion which is formed in such a manner as to extend in a rod shape and is electrically connected to a main body-side conductive member for carrying electric power from the electric supply means.

12. The image forming apparatus according to claim 11, further comprising: a connecting slot member which restricts the movement of the connecting end portion, and into which the main body-side conductive member is fitted with a distal end thereof abutting against the connecting end portion.

* * * * *

UNITED STATES PATENT AND TRADEMARK OFFICE

CERTIFICATE OF CORRECTION

PATENT NO. : 6,973,276 B2
APPLICATION NO. : 10/618031
DATED : December 6, 2005
INVENTOR(S) : Mizoguchi Yoshihiro It is certified that error appears in the above-identified patent and that said Letters Patent is hereby corrected as shown below:

Cover Page, Item (57), Abstract, line 16, please delete "width wise" and insert therefor -- widthwise --.
Column 9, line 9, please delete "a" and insert therefor -- as --.
Column 10, claim 1, line 51, please delete the first occurrence of "is".

Signed and Sealed this

Fifth Day of June, 2007

JON W. DUDAS
*Director of the United States Patent and Trademark Office*